United States Patent [19]

Lepisto et al.

[11] Patent Number: 4,567,987

[45] Date of Patent: Feb. 4, 1986

[54] EASY OPENING PINCH BOTTOM BAG

[75] Inventors: J. George Lepisto, Middletown; Paul Hain, Hamilton, both of Ohio

[73] Assignee: Champion International Corporation, Stamford, Conn.

[21] Appl. No.: 644,364

[22] Filed: Aug. 27, 1984

[51] Int. Cl.[4] ..... B65D 33/20; B65D 27/38

[52] U.S. Cl. ..... 206/616; 206/618

[58] Field of Search ..... 206/616, 617, 618

[56] References Cited

U.S. PATENT DOCUMENTS

| | | | |
|---|---|---|---|
| 2,172,930 | 9/1939 | Bensel | 206/616 |
| 2,998,911 | 9/1961 | Hahn et al. | 206/610 |
| 3,054,551 | 9/1962 | Holbrook et al. | 206/618 |
| 3,565,328 | 2/1971 | Hudson | 206/610 |
| 3,807,626 | 4/1974 | Goodrich | 206/618 |
| 3,850,366 | 11/1974 | Saito | 206/616 |
| 3,958,749 | 5/1976 | Goodrich | 206/616 |
| 3,973,045 | 8/1976 | Brandberg et al. | 206/618 |

*Primary Examiner*—Stephen P. Garbe

*Attorney, Agent, or Firm*—Evelyn M. Sommer

[57] ABSTRACT

An improved easy opening pinch bottom or gusset bag is provided. The bag includes opposed front and back panels and opposed pairs of front and rear gusset panels foldably connected to one another. The rear gusset panels and the rear panel are of a sufficient dimension to fold over the front panel to close the bag. A tear strip is secured to the front panel at a location to be overlapped by the rear gusset panels and the rear panel when the bag is closed. The portions of the rear gusset panels and the rear panel that will lie adjacent the tear strip in the closed condition of the bag are provided with short perforation lines to facilitate the initial advancement of the tear strip through the rear gusset panels and the rear panel. These perforation lines extend only a short distance so that the overall strength of the bag is not adversely affected.

6 Claims, 4 Drawing Figures

EASY OPENING PINCH BOTTOM BAG

BACKGROUND OF THE INVENTION

Gusset bags or pinch bottom bags with easy opening features are well known. Certain such bags are provided with selectively disposed arrays of abhesive. An example of such a bag is shown in U.S. Pat. No. 3,708,106. Other bags are provided with tear strips to facilitate opening, such as the bag shown in U.S. Pat. No. 2,415,139. Still other bags are provided with recloseable tin-ties, such as the bag shown in U.S. Pat. No. 3,719,318. Bags also have been made with separate plastic or metal clip members such as the bag shown in U.S. Pat. No. 4,142,346.

Securely closed bags provided with tear strips such as strings, or hot melt sticks are desirable in many instances where a strong closure is required and where it is necessary to protect against sifting or leaking of the material stored in the bag. Bags of this type are closed by folding the extreme ends of the gusset panels in to face-to-face relationship with one another. A tear strip of some sort then is affixed on either the front or back wall of the bag. The extreme top end of the bag then is folded over the tear strip and is secured in this folded condition. The bag can be opened by pulling on the tear strip, thereby at least partly severing the folded top portion of the bag.

Although many bags of the above described general construction have proved quite functional, it has become desirable to provide a securely closed but easy opening bag with a tear strip that can readily accomodate material of substantial weight. In the prior art bags of this type, it has been found that when the bag is manufactured from a heavy gauge of material, it has been difficult to accurately and reliably advance the tear strip through the material. A continuous array of perforations extending across the bag facilitates the initial opening of the bag, but can make the bag undesireably weak. In the past, high strength bags of this type have addressed this problem by providing fewer plies of material in the top folded over portion of the bag. However this also can make the bag too weak. Still others have addressed this problem by incorporating abhesive adjacent the top closure. Although certain bags, with abhesives are functional, and can be opened easily, abhesives generally have not facilitated the use of tear strips.

In view of the above, it is an object of the subject invention to provide a pinch bottom or gusset bag that can be easily opened by a tear strip.

It is another object of the subject invention to provide a pinch bottom or gusset bag that can securely retain a substantial weight of material but can be easily opened.

It is an additional object of the subject invention to provide a pinch bottom or gusset bag that does not require the use of abhesives.

It is a further object at the subject invention to provide a pinch bottom or gusset bag having a tear strip opening wherein the tear strip reliably will provide a clean severence of the top portion of the bag.

SUMMARY OF THE INVENTION

The subject invention is directed to an improved bag having opposed front and back panels and opposed pairs of gusset panels. More particularly the gusset panels in each pair are foldably connected to one another and to the front and back panels adjacent thereto. The bottom of the bag is securely and substantially permanently closed by collapsing the bottom portion of the bag such that the front and back walls are parallel to one another, and are in face-to-face contact with either each other or the gusset panels. This collapsed bottom of the bag is folded over at least one time and securely affixed in this closed condition by an appropriate means, such as adhesive.

The top end of the bag is characterized by a back panel that extends a further distance from the bottom of the bag than the front panel does. Thus, the uppermost part of the back panel defines a closure flap. The back gusset panel also extends a further distance from the bottom of the bag than either the front gusset panel or the front panel. The front panel of the bag is characterized by a tear strip adhered to the front panel and spaced slightly from and parallel to the top edge of the front panel. An adhesive area extends substantially across the front panel and is spaced from the top edge thereof a distance at least as great as the spacing of the tear strip therefrom. Thus, the tear strip is disposed intermediate the adhesive strip and the extreme top end of the bag.

A relatively short array of perforations is disposed in the back panel extending inwardly from the side thereof adjacent the portion of the tear strip which will be grasped by the user of the bag. This short array of perforations is spaced from the bottom of the bag a distance approximately equal to the length of the front panel plus the distance by which the tear strip is spaced from the top edge of the front panel. Similarly, the rear gusset panel is provided with a short array of perforations which extends inwardly from the edge thereof adjacent to the portion of the tear strip which will be grasped initially by the user. The spacing of this array of perforations on the rear gusset panel from the bottom of the bag is substantially equal to the spacing of the perforation array on the rear panel from the bottom of the bag.

In a similar manner the opposed rear gusset panel also is provided with a short array of perforations. This array of perforations on the opposed rear gusset panel is disposed at a substantially identical spacing from the bottom of the bag. However, the array of perforations on the opposed rear gusset panel extends from the inner edge of the rear gusset panel, or the edge thereof adjacent the front gusset panel. This array of perforations extends to a point intermediate the two longitudinal edges of the rear gusset panel.

The bag of the subject invention can be filled in the conventional manner. After the bag is filled the desired amount the upper most portions of the rear panel and the rear gusset panels are folded over the front panel and are adhered thereto. More particularly the uppermost portion of the rear panel is adhered to the front panel substantially across the entire width of their connection. This seal of the subject bag provides adequate protection against leakage or spillage.

The bag can be opened by pulling on the tear strip extending from one end thereof. The tear strip can readily be pulled through the material from which the bag is formed because of the short arrays of perforations in the rear panel and the rear gusset panels. More particularly the initial movement of the tear strip through the rear gusset panel and the rear panel is facilitated by the short array of perforations extending inwardly from the edge of the bag adjacent the portion of the tear strip which will be grasped by the user. After this initial severance of the bag is made the remainder of the movement of the tear strip through the rear panel and rear gusset panel can be accomplished with relative ease. As the tear strip approaches the opposed rear gusset panel, the initial movement of the tear strip through this opposed rear gusset panel is facilitated by the short array of perforations extending from the inner longitudinal edge of the rear gusset panel. After the tear strip advances through the initial portion of this rear gusset panel, the remainder of the movement of the tear strip therethrough is relatively easy.

In a preferred embodiment as explained further below, release pads can be disposed on the front panel to facilitate removal of the severed portion of the rear panel therefrom or to provide an alternate means of opening the bag.

DETAILED DESCRIPTION OF THE PREFERRED EMBODIMENT

Figure 1:
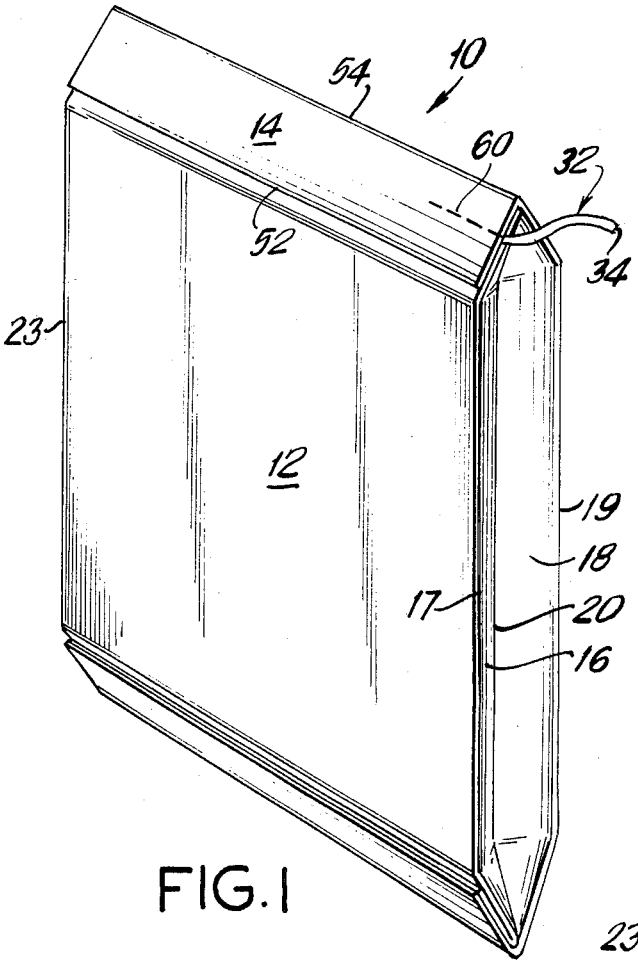
FIG. 1 is a perspective view of the closed bag of the subject invention.
Figure 2:
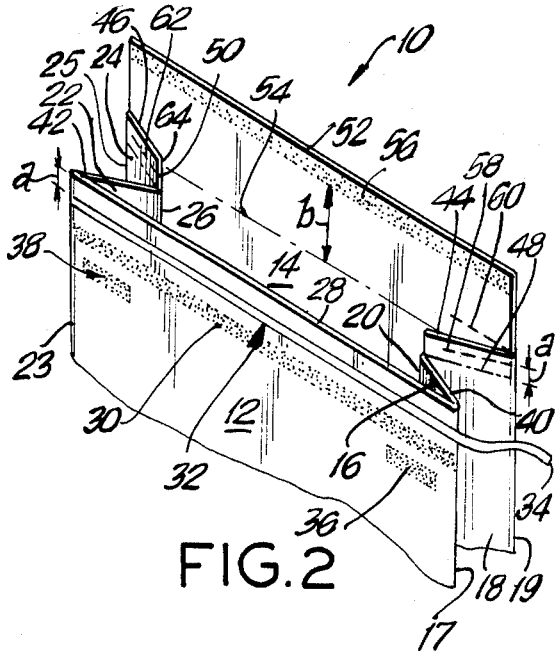
FIG. 2 is a perspective view of a portion of the bag of the subject invention in an opened condition.
Figure 3:
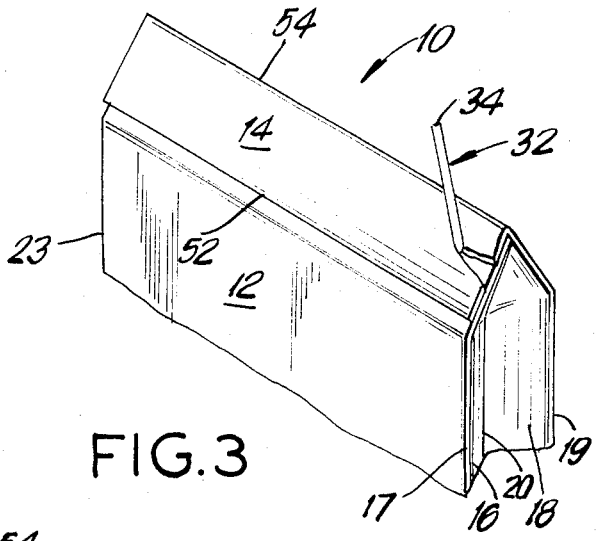
FIG. 3 is a perspective view of the bag of the subject invention at an intermediate stage during its opening.

The bag of the subject invention is indicated generally by the numeral 10 in FIGS. 1 through 4. The bag 10 includes opposed generally rectangular front and rear panels 12 and 14 which are disposed in generally parallel relationship to one another. A first front gusset panel 16 is articualted to a side of the front panel 12 along fold line 17. A first rear gusset panel 18 is articulated to a side of the rear panel 14 along fold line 19. The first front gusset panel 16 and first rear gusset panel 18 are articulated to one another along fold line 20. Fold line 20 extends generally parallel to fold line 17 and 19. In a similar manner a second front gusset panel 22 is articulated to the opposite side of front panel 12 along fold line 23. Second rear gusset panel 24 is articulated to the opposed side of the rear panel 14 along fold line 25. The second front gusset panel 22 and the second rear gusset panel 24 are articulated to one another along fold line 26 which extends parallel to fold lines 23 and 25.

The front panel 12 is characterized by a top edge 28 which extends generally perpendicularly between the opposed sides 17 and 23. An adhesive strip 30 extends substantially entirely across the front panel 12 between side edges 17 and 23 thereof. The adhesive strip 30 is generally parallel to and spaced from the top edge 28 of the front panel 12.

A tear strip 32 is affixed to the front panel 12 generally parallel to the top edge 28 thereof and intermediate top edge 28 and the adhesive strip 30. The spacing between the top edge 28 and the tear strip 32 is indicated by dimension "a" in FIG. 2. One end 34 of tear strip 32 extends beyond edge 17 of front panel 12 a sufficient distance to enable the tear strip 32 to be easily grasped between end 34 and edge 17 of front panel 12. The tear strip 32 may be a string, a hot melt stick string or other tear strip known to the person skilled in this art. The tear strip 32 must, however, be of a sufficient tensile strength to withstand the forces placed thereon as the tear strip 32 is urged through the material from which bag 10 is formed.

The front panel 12 further includes release pads 36 and 38 which are formed from an appropriate abhesive material coated on front panel 12. More particularly the release pads 36 and 38 are spaced inwardly from the opposed sides 17 and 23, and are disposed such that the adhesive strip 30 is located intermediate the top edge 28 and the release pads 36 and 38. The coating material from which the release pads 36 and 38 are formed will depend upon the type of adhesive used elsewhere on the bag. Generally, the function of the release pads is to facilitate at least the initial separation of an adhesively attached material. A more detailed explanation of the function of release pads 36 and 38 is provided below.

The first and second front gusset panels 16 and 22 are characterized by top edges 40 and 42. The dimensions of the first and second front gusset panels 16 and 22 are such that when the bag 10 is collapsed the top edges 40 and 42 thereof respectively are substantially adjacent to the top edge 28 of the front panel 12.

The first and second rear gusset panels 18 and 24 are defined by top edges 44 and 46 respectively. The first and second rear gusset panels 18 and 24 are dimensioned such that when the bag 10 is in its collapsed condition the top edges 44 and 46 of the rear gusset panels 18 and 24 are not adjacent the top edges 40 and 42 of the front gusset panels 16 and 22 respectively. Rather, the top edges 44 and 46 are spaced further from the opposed end of bag 10. The first and second rear gusset panels 18 and 24 are further characterized by fold lines 48 and 50. The fold lines 48 and 50 are spaced from the top edges 44 and 46 a sufficient amount such that when the bag 10 is in its collapsed condition the fold lines 48 and 50 are generally adjacent the top edges 40 and 42 of the first and second front gusset panels 16 and 22.

The rear panel 14 is further defined by top edge 52 and by fold line 54. The fold line 54 is generally parallel to but spaced from the top edge 52. More particularly the fold line 54 is disposed such that in the collapsed condition of bag 10 fold line 54 is generally adjacent to fold lines 48 and 50 and to the top edges 40 and 42 of first and second front gusset panels 16 and 22, and to the top edge 28 of front panel 12. An adhesive strip 56 is disposed substantially adjacent to the top edge 52 of rear panel 14. More particularly the adhesive strip 56 is disposed on the inwardly facing surface of rear panel 14. The spacing of the adhesive strip 56 from the fold line 54 is substantially equal to the spacing of release pads 36 and 38 from the top edge 28 of front panel 12.

The first rear gusset panel 18 and the rear panel 14 are provided with perforation lines 58 and 60 respectively which extend a short distance away from fold line 19. More particularly the perforation line 58 on the first rear gusset panel is disposed intermediate and parallel to the fold line 48 and the top edge 44 thereof. The line of perforations 58 extends from fold line 19 to a point intermediate fold lines 19 and 20. The perforation line 60 is approximately equal in length to perforation line 58. Furthermore, the perforation lines 58 and 60 are disposed such that when the bag 10 is in its collapsed condition, the perforation lines 58 and 60 will be substantially adjacent one another.

In a similar manner, the second rear gusset panel 24 is provided with a perforation line 62 which is parallel to and intermediate the fold line 50 and the top edge 46 thereof. Perforation line 62 extends toward fold line 25 from the edge 64 of the second rear gusset panel 24 opposite fold line 25.

The above described bag is filled with an appropriate material, and is sealed into the condition illustrated in FIG. 1. This closed condition is maintained by the activation of adhesive strips 30 and 56 to securely hold the folded over portion of the rear panel 14 against the front panel 12. In this folded over condition, the perforation lines 58, 60 and 62 will be substantially in line with the tear strip 32. Furthermore, the portion of the tear strip 32 adjacent end 34 thereof will extend beyond the folded over portion of rear panel 14 as illustrated in FIG. 1.

The bag 10 is opened for use by exerting a pulling force on the portion of tear strip 32 adjacent end 34 thereof. This pulling force will cause the tear strip 32 to advance through the folded over portion of rear panel 14. The initial movement of tear strip 32 through the folded over portion of rear panel 14 and the adjacent portions of the first and second rear gusset panels 18 and 24 is greatly facilitated by the perforation lines 58, 60 and 62. More particularly, the initial force exerted on the tear strip 32 will easily enable the advancement of tear strip 32 through the portions of the first rear gusset panel 18 and the rear panel 14 adjacent perforation lines 58 and 60 thereof. After this initial severance of the folded over portion of bag 10, a continued force on the tear strip 32 will enable an easy and accurate severance of the small remaining portion of the first rear gusset panel 18 and the remainder of the folded over portion of rear panel 14. As the tear strip 32 reaches the folded over portion of the second rear gusset panel 24, the initial movement of the tear strip through the second rear gusset panel 24 is facilitated by the perforation line 62 therein. An additional force exerted on tear strip 32 will enable a complete opening of the bag 10 as illustrated in FIG. 4, and a separation of the tear strip 32 from the bag 10.

Figure 4:
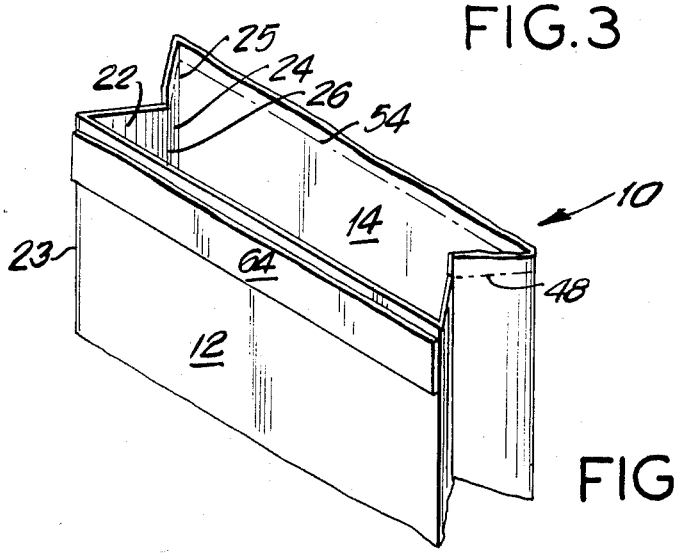
FIG. 4 is a perspective view of the bag of the subject invention after it has been completely opened.

The portion of the rear panel 14 that remains adhered to the front panel 12 is identified by the numeral 64 in FIG. 4. This remaining portion 64 can be removed from the front panel 12, if desired. This removal of portion 64 is facilitated by the presence of the release pads 36 and 38 intermediate portion 64 and front panel 12. The release pads 36 and 38 also can be used to open the bag 10 from the condition shown in FIG. 1 to the condition shown in FIG. 2 without the use of the tear strip 32.

In summary an improved easy opening pinch bottom or gusset bag is provided. The bag is of generally gusset panel construction with opposed front and rear panels and opposed pairs of front and rear gusset panels. The rear gusset panels and the rear panels are longer than the front panel and front gusset panels thereby enabling the rear panel and rear gusset panels to be folded over to close the bag. A tear strip is adhered to the front panel adjacent the portion thereof that will be overlapped by the rear panel when the bag is closed. Perforation lines are disposed in the portions of the rear gusset panels and the rear panel that will lie adjacent the tear strip in the closed condition of the bag. The perforation lines are positioned to facilitate the initial advancement of the tear strip through the rear gusset panels and the rear panel thereby insuring an easy and reliable opening of the subject bag. Release pads also can be disposed on the front panel to facilitate either separation of the severed portion of the rear panel from the bag or an alternate opening for the bag.

While the preferred embodiment of the invention has been described and illustrated, it is obvious that various changes can be made therein without departing from the spirit of the present invention which should be limited only by the scope of the appended claims.

What is claimed is:

1. An improved easy opening gusset bag comprising:

opposed generally rectangular front and rear panels, each having top edges;

first and second front gusset panels articulated to opposed sides of said front panel along parallel fold lines;

first and second rear gusset panels articulated to opposed sides of said rear panel along parallel fold lines, said first front gusset panel and said first rear gusset panel being articulated to one another, said second front gusset panel and said second rear gusset panel being articulated to one another, said first and second rear gusset panels each including an edge extending from their respective articulations to the first and second front gusset panels, said edges of said first and second rear gusset panels being disposed generally opposite the respective articulations of said first and second rear gusset panels to the rear panel;

said bag including opposed closed top and bottom ends, said rear panel and said first and second rear gusset panels being folded over said front panel along a top fold line to define the closed top end of said bag; and a tear strip disposed on the front panel spaced from and parallel to the top edge of said front panel and substantially adjacent the closed top end of the bag, said tear strip being intermediate the front panel and the folded over portions of said first and second rear gusset panels, said rear panel and said rear gusset panels being characterized by perforation lines disposed substantially adjacent said tear strip, the perforation lines of said first rear gusset panel and said rear panel overlying each other and extending from the articulation between said first rear gusset panel and said rear panel to a point spaced from said edge of said first rear gusset panel, such that the remainder of said rear panel and the first rear gusset panel are free of perforations, the perforation line of said second rear gusset panel extending from the edge thereof to a location intermediate said edge and the articulation between said second rear gusset panel and said rear panel such that the remainder of said second rear gusset panel is free of perforations, whereby said perforations facilitate the initial severence of said first rear gusset panel and said rear panel by the tear strip and then facilitate the initial severence of said second rear gusset panel by said tear strip to enable an easy and complete opening of the top end of said gusset bag.

2. A bag as in claim 1 wherein the perforation lines in said first rear panel and said rear gusset panel extend generally perpendicularly from the articulation between said first rear gusset panel and said rear panel.

3. A bag as in claim 2 wherein the perforation lines in said first rear gusset panel and said rear panel are substantially adjacent to one another.

4. A bag as in claim 1 wherein the tear strip is a tear string.

5. A bag as in claim 1 wherein the tear strip is a hot melt stick string.

6. An improved easy opening gusset bag comprising:

opposed generally rectangular front and rear panels;

first and second front gusset panels articulated to opposed sides of said front panel along parallel fold lines;

first and second rear gusset panels articulated to opposed sides of said rear panel along parallel fold lines, said first front gusset panel and said first rear gusset panel being articulated to one another, and said second front gusset panel and said second rear gusset panel being articulated to one another;

said bag including opposed closed top and bottom ends, said rear panel and said first and second rear gusset panels being folded over said front panel to define the closed top end of said bag;

a tear strip disposed substantially adjacent the closed top end of the bag and intermediate the front panel and the folded over portions of said first and second rear gusset panels and said rear panel, the folded over portion of said first and second rear gusset panels and said rear panels being characterized by perforation lines disposed substantially adjacent said tear strip, said perforation lines extending partly across the respective first and second rear gusset panels and said rear panel; and release pads disposed on portions of said front panel adjacent the folded over portion of said rear panel, said release pads facilitating the separation of the folded over portion of said rear panel from the front panel.

* * * * *